US005148156A

United States Patent [19]

Huber et al.

[11] Patent Number: 5,148,156

[45] Date of Patent: Sep. 15, 1992

[54] ELECTRONIC DISPLAY DEVICE HAVING A PLURALITY OF PIXEL ELEMENTS

[75] Inventors: Terrence D. Huber; Duane B. Kutsch, both of Spokane; Donald R. Skinfill, Veradale, all of Wash.

[73] Assignee: American Electronic Sign Company, Spokane, Wash.

[21] Appl. No.: 533,740

[22] Filed: Jun. 6, 1990

[51] Int. Cl.[5] ..... G09G 3/20

[52] U.S. Cl. ..... 340/783; 340/815.24; 340/815.27; 40/449

[58] Field of Search ..... 340/763, 764, 783, 815.24, 340/815.27, 815.29; 40/449, 450, 451, 452, 492

[56] References Cited

U.S. PATENT DOCUMENTS

| | | | |
|---|---|---|---|
| 755,272 | 3/1904 | Burnham . | |
| 1,191,023 | 7/1916 | Naylor . | |
| 3,025,512 | 3/1962 | Bloechl . | |
| 3,036,300 | 5/1962 | Knight . | |
| 3,140,553 | 7/1964 | Taylor et al. . | |
| 3,169,241 | 2/1965 | Aiken . | |
| 3,186,115 | 6/1965 | Todt et al. . | |
| 3,210,757 | 10/1965 | Jacob . | |
| 3,266,033 | 8/1966 | Frohbach | 340/324 |
| 3,283,427 | 11/1966 | Winrow . | |
| 3,295,238 | 1/1967 | Winrow . | |
| 3,303,494 | 2/1967 | Taylor . | |
| 3,365,824 | 1/1968 | Winrow . | |
| 3,426,453 | 2/1969 | Dingwall . | |
| 3,460,276 | 8/1969 | Payne . | |
| 3,469,258 | 9/1969 | Winrow . | |
| 3,482,344 | 12/1969 | Holloman . | |
| 3,486,258 | 12/1969 | Mueller . | |

(List continued on next page.)

FOREIGN PATENT DOCUMENTS

| | | |
|---|---|---|
| 355440 | 8/1931 | Canada . |
| 641350 | 5/1962 | Canada . |
| 1103451 | 6/1981 | Canada . |
| 934001 | 8/1963 | United Kingdom . |

OTHER PUBLICATIONS

IQ Technologies, Inc. SC, 187 "Universal RS 232 Smart Cable" 1-3 Dec. 1983.

*Primary Examiner*—Jeffery A. Brier
*Attorney, Agent, or Firm*—Seed and Berry

[57] ABSTRACT

A display device including a plurality of pixel elements arranged in matrix form. Each of the pixel elements can be set to one of two alternative states. In the first state, each pixel element includes a portion that transmits light and an adjacent portion that reflects light. In the second, alternate state, each pixel element includes a single portion that is substantially non-reflective. The display device includes a substrate having a plurality of hole disposed therein for respectively receiving a plurality of pixel elements. Each of the pixel elements includes a translucent member adapted to abut against the back side of the substrate and covers one of the holes therein; a mounting bracket adapted to abut against the front side of the substrate and having a fastener extending through the hole of the substrate and connecting to the translucent member for securing the translucent member to the substrate; a flap pivotally secured to the bracket about a pivot axis, one side of the flap having a non-reflective surface and the other side of the flap having a reflective surface, the flap being pivotal from a first position where the non-reflective surface faces outwardly towards a viewer to a second position approximately 180° from the first position where the reflective surface faces outwardly towards a viewer; a magnet disposed on the flap; an electromagnet secured to the back side of the substrate and having a pole piece disposed axially therein and extending into the translucent member; and a source for supplying electric current to the electromagnet so as to alternatively energize the pole piece to be a south pole piece or a north pole piece wherein when the pole pieces are energized to be either a north pole piece or a south pole piece the flap is pivoted to the first position and when the pole pieces are energized to be the other of the north pole piece and the south pole piece the flap is pivoted to the second position.

13 Claims, 6 Drawing Sheets

U.S. PATENT DOCUMENTS

| | | | |
|---|---|---|---|
| 3,518,664 | 6/1970 | Taylor . | |
| 3,552,048 | 1/1971 | O'Keefe . | |
| 3,562,938 | 2/1971 | Salam . | |
| 3,624,941 | 12/1971 | Chantry . | |
| 3,724,110 | 4/1973 | Meyerson . | |
| 3,745,563 | 7/1973 | Jones et al. . | |
| 3,825,927 | 7/1974 | Passien . | |
| 3,942,274 | 3/1976 | Winrow . | |
| 3,990,165 | 11/1976 | Vogt . | |
| 3,991,496 | 11/1976 | Helwig et al. . | |
| 3,995,386 | 12/1976 | Salam . | |
| 4,015,255 | 3/1977 | Wood . | |
| 4,040,193 | 8/1977 | Matsuda et al. . | |
| 4,070,668 | 1/1978 | Kawaharada et al. . | |
| 4,115,936 | 9/1978 | Nidelkoff | 40/449 |
| 4,161,832 | 7/1979 | Bergamini | 40/451 |
| 4,163,332 | 8/1979 | Salam . | |
| 4,215,338 | 7/1980 | Selig . | |
| 4,259,801 | 4/1981 | Ito | 40/449 |
| 4,308,528 | 12/1981 | Hummel et al. . | |
| 4,318,098 | 3/1982 | McGreevy | 340/764 |
| 4,327,357 | 4/1982 | Skrobisch . | |
| 4,410,888 | 10/1983 | Selig | 340/815.05 |
| 4,466,207 | 8/1984 | Salam | 40/449 |
| 4,539,768 | 9/1985 | Halliday | 40/447 |
| 4,578,533 | 3/1986 | Pierce . | |
| 4,587,753 | 5/1986 | Harper | 40/451 |
| 4,627,182 | 12/1986 | Weiss | 40/447 |
| 4,694,599 | 9/1987 | Hart et al. | 40/449 |
| 4,819,357 | 4/1989 | Salam | 40/449 |
| 4,983,956 | 1/1991 | Salam | 340/783 |

ELECTRONIC DISPLAY DEVICE HAVING A PLURALITY OF PIXEL ELEMENTS

DESCRIPTION

1. Technical Field

This invention relates to an electronic display device having a plurality of pixel elements arranged in a matrix form.

2. Background of the Invention

Electronic display devices are known in the art. U.S. Pat. No. 4,163,332 discloses an information display device, including a plurality of electronic pixel elements which are arranged in horizontal and vertical rows. Each of the pixel elements includes an opaque sheet having an aperture provided therein and having an associated flap which is pivotable from a first position covering the aperture to a second position uncovering the aperture. The side of the flap which faces an observer when the aperture is covered is a non-reflective surface. The other side of the flap which faces an observer when the flap is uncovered is a highly reflective surface. Accordingly, when the flap is open, light is emitted through the aperture towards the observer and is reflected towards the observer off the reflective surface of the flap. In contrast, when the flap is closed, the low reflective surface of the flap faces the observer. The flap is actuated by utilizing a permanent magnet secured to the flap and a U-shaped electromagnet.

Accordingly, U.S. Pat. No. 4,163,332 discloses an electronic display device utilizing a plurality of pixel elements with flip-flop type flaps. However, the '332 patent does not disclose a display device that can be easily assembled. Rather, each of the pixel elements are independently arranged in matrix form, each element requiring separate wiring and each flap being pivotable about its own pivot rod. Moreover, the electronic pixel element disclosed in the '332 patent utilizes a U-shaped electromagnet having a single coil wrapped therearound. Accordingly, in order to change the polarity of the magnet it is necessary to reverse the direction of the current flow through the coil.

SUMMARY OF THE INVENTION

The present invention resides in a display device comprising a plurality of pixel elements arranged in matrix form. Each of the pixel elements can be set to one of two alternative states. In the first state, each pixel element includes a portion that transmits light and an adjacent portion that reflects light. In the second, alternate state, each pixel element includes a single portion that is substantially non-reflective. Accordingly, by appropriately energizing each of the pixel elements, a specified group of pixel elements can be set to the first state, emitting and reflecting light, and another group of pixel elements can be set to the second state, not emitting or reflecting light, to thereby display a message.

The display device includes a substrate having a plurality of holes disposed therein for respectively receiving a plurality of pixel elements. Each of the pixel elements includes a translucent member adapted to abut against the back side of the substrate and covers one of the holes therein; a mounting bracket adapted to abut against the front side of the substrate and having a fastening means extending through the hole of the substrate and connecting to the translucent member for securing the translucent member to the substrate; a flap pivotally secured to the bracket about a pivot axis, one side of the flap having a non-reflective surface and the other side of the flap having a reflective surface, the flap being pivotal from a first position where the non-reflective surface faces outwardly towards a viewer to a second position, approximately 180° from the first position, where the reflective surface faces outwardly towards the viewer; a magnet disposed on the flap; an electromagnet secured to the back side of the substrate and having a pole piece disposed axially therein and extending into the translucent member; and a power source for supplying electric current to the electromagnet so as to alternatively energize the pole piece to be a south pole piece or a north pole piece wherein when the pole pieces are energized to be either a north pole piece or a south pole piece the flap is pivoted to the first position and when the pole pieces are energized to be the other of the north pole piece and the south pole piece the flap is pivoted to the second position.

Each of the flaps of adjacent pole pieces in the horizontal direction are secured to each of the brackets by utilizing a single pivot rod which extends substantially the entire width of the substrate. In this manner, the pixel element can be quickly assembled to the substrate.

The substrate is a printed circuit board having the necessary electrical circuitry for the appropriate energization of the electromagnets. Accordingly, independent wiring is not required for each of the pixel elements.

Each of the pole pieces is substantially L-shaped, one leg of the pole piece extending axially through the electromagnet and the other leg of the pole piece extending into the translucent member in a direction parallel with respect thereto. The leg which extends into the translucent member has a predetermined length and is disposed perpendicularly to the pivot axis of the flap. Each of the magnets is disposed on each of the flaps such that in the first and second positions each of the magnets is disposed adjacent each of the pole pieces.

DETAILED DESCRIPTION OF THE INVENTION

Figure 1:
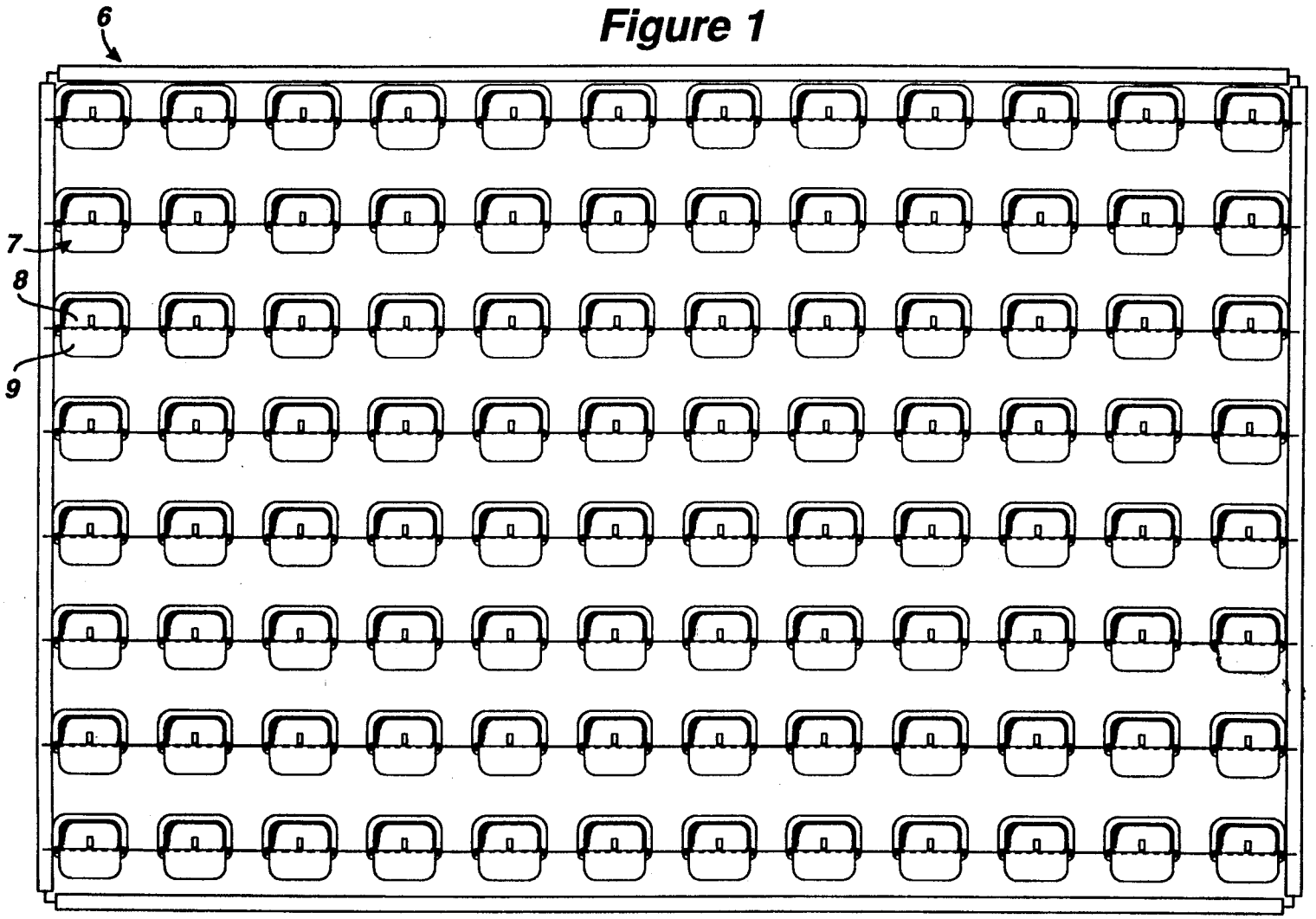
FIG. 1 is a front view of the electronic display device a according to the present invention.

Referring to FIG. 1, the electronic display device 6 includes a two-dimensional array of pixel elements 7 arranged in columns and rows. Each of the pixel elements can be set to one of two alternative states, on or off. In the on state, each pixel element includes a portion 8 that transmits light and an adjacent portion 9 that reflects light. In the off state, each pixel element 7 includes a single portion that is substantially non-reflective. Accordingly, as will be described in greater detail below, by appropriately energizing each of the pixel elements, a specified group of pixel elements can be set to the on state, emitting and reflecting light, and another group of pixel elements can be set to the off state, not emitting or reflecting light. In this manner, the array of pixel elements can combine to display a message.

Figure 2:
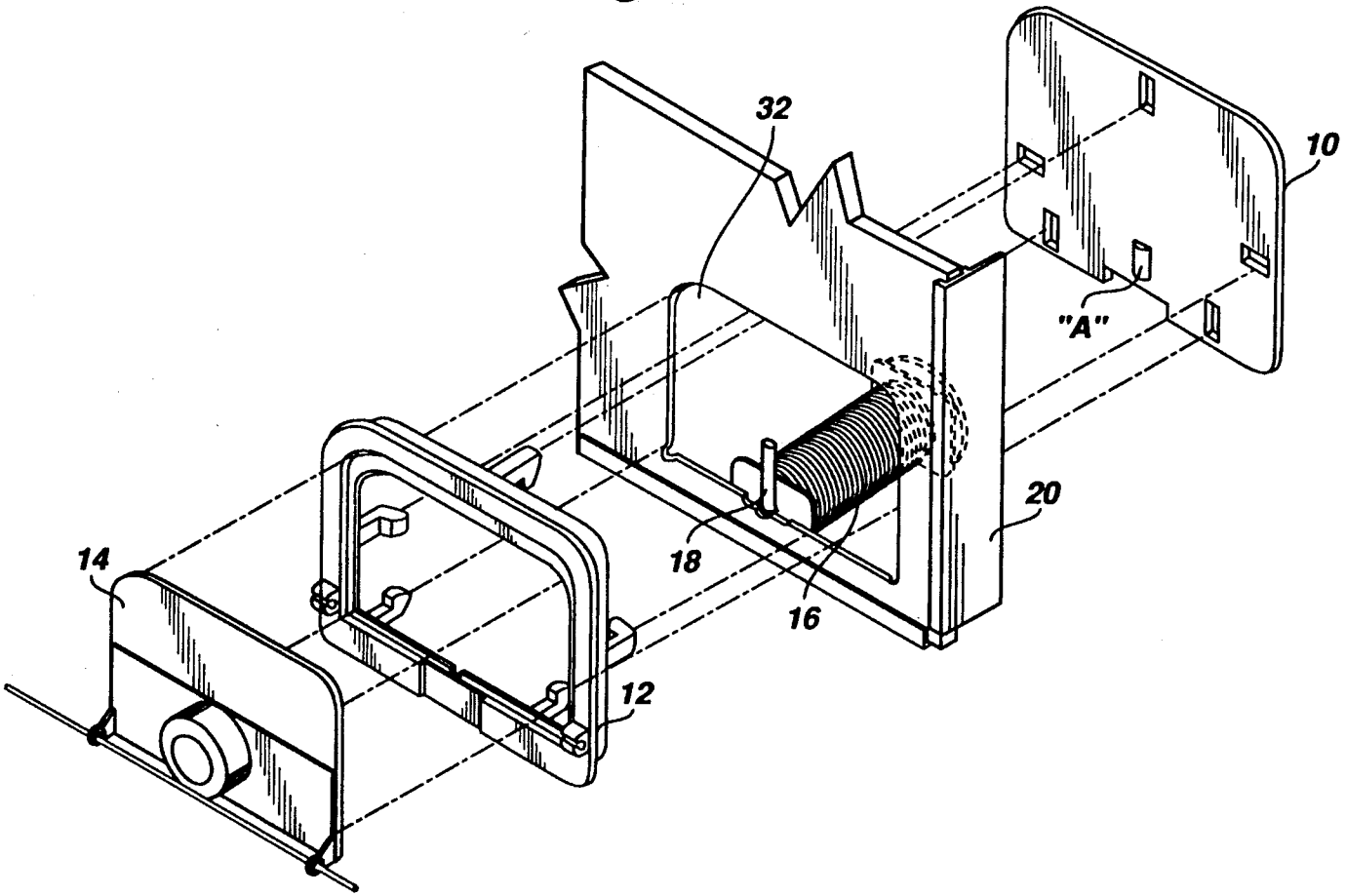
FIG. 2 is an exploded view of one of the pixel elements.

FIGS. 2–7 illustrate a single pixel element. Referring to FIG. 2, each of the pixel elements 7 includes a translucent member 10, bracket 12, flap 14, electromagnet 16, and pole piece 18. Each of the pixel elements is secured to a substrate 20 constituting a portion of the electronic display device. As shown in the figures, each of the pixel elements is secured to the substrate by snapping each of the brackets, positioned on the front of the substrate 20, to each of the translucent members 10, positioned on the back of the substrate. Each of the flaps is pivotally secured to the brackets about a horizontal axis so as to be pivotable from a first position covering the translucent members, illustrated in FIGS. 3 and 4, to a second position uncovering the translucent members, illustrated in FIGS. 4 and 5. The side of 13 of each of the flap that is exposed to view when the flap is in the first position (off state) is substantially non-reflective while the other side 15 which is exposed to view when the flap is in the second position (on state) is highly reflective. Accordingly, as described above, by pivoting the flap each of the pixel elements can be switched from the on state, emitting and reflecting light, to the off state, not emitting or reflecting light, and vice versa.

Referring to FIGS. 2–7 again, the construction of each of the pixel elements is as follows. The electromagnet 16 protrudes outwardly from the back 22 of the substrate 20 and is secured thereto. The pole piece 18 is substantially L-shaped, including an axial leg 26 disposed axially in the electromagnet and a radial leg 28 which extends into the side of the translucent member 10. The translucent member 10 is abutted against the back of the panel and secured in that position by means of the bracket 12. More specifically, as illustrated in the figures, the bracket 12 is substantially rectangular in shape and has an opening in the center portion thereof. The bracket is disposed on the front of the substrate and includes a plurality of legs 30 which protrude from the bracket and extend through the aperture 32 of the substrate 20. Each of the legs has an L-shaped lip 34 which protrudes perpendicular therefrom. The legs 30 are respectively inserted into a plurality of holes 36 provided in the translucent member 10 in such a manner that the lips of each of the legs act to secure the bracket and the translucent member to the substrate, as specifically illustrated in FIGS. 4 and 6. Accordingly, the translucent member and the bracket can quickly and easily be secured to the substrate.

Figure 3:
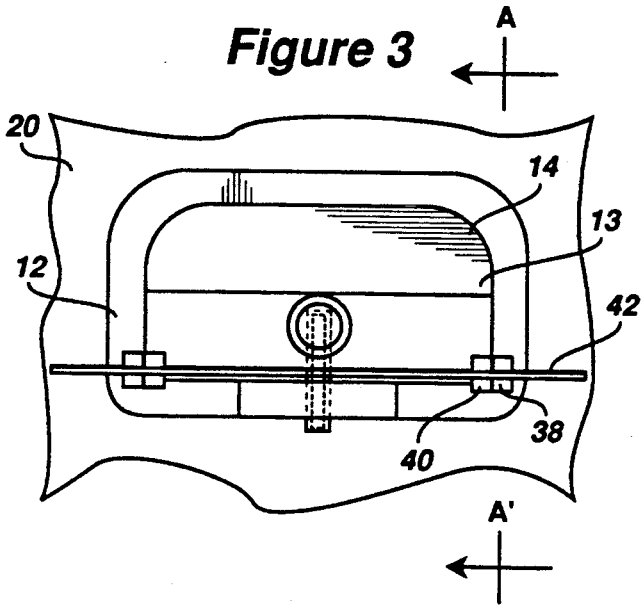
FIG. 3 is a front view of one of the pixel elements with the flap in the closed position.

Referring to FIG. 3, the bracket 12 has a pair of hinges 38 extending therefrom in the direction of the front 23 of the substrate 20. Correspondingly, the flap 14 also includes a pair of hinges 40 which extend therefrom. A pivot rod 42 extends through the hinges 38, 40 of the bracket 12 and flap 14, respectively, thereby pivotally securing the flap to the bracket, as will be described in further detail below. In this manner, the flaps can be pivoted from the first position to the second position, as described above.

Figure 4:
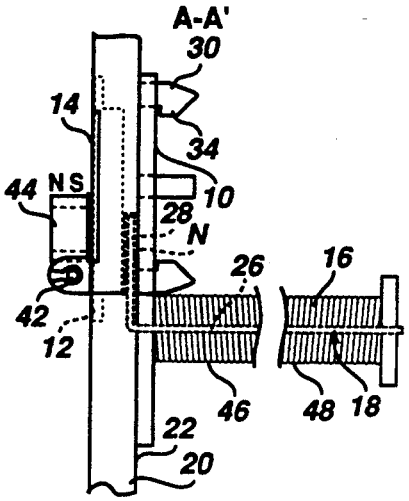
FIG. 4 is a sectional view of the pixel element taken along line A—A' of FIG. 3.
Figure 5:
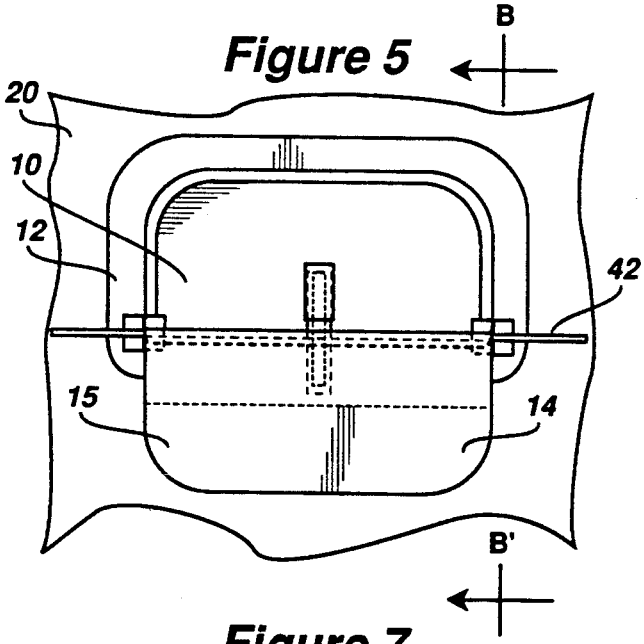
FIG. 5 is a front view of the pixel element with the flap in the opened position.

As illustrated in FIGS. 3–6, the flap 14 has a magnet 44 secured thereto. The positioning of the magnet on the flap and the corresponding position of the pole piece 18 are important for proper functioning of the device. In particular, the magnet is disposed on the flap at a predetermined distance from the axis of rotation of the flap. The radial leg 28 of the pole piece extends perpendicularly to the pivot rod 42. The length and positioning of the radial position of the pole piece is designed to insure that a portion of the pole piece is adjacent the center of the magnet when the flap is in both the closed position (FIG. 3) and the opened position (FIG. 5). In this manner, energization of the electromagnet causes the flap to pivot from the first position to the second position, and vice versa, in a precise manner.

Figure 6:
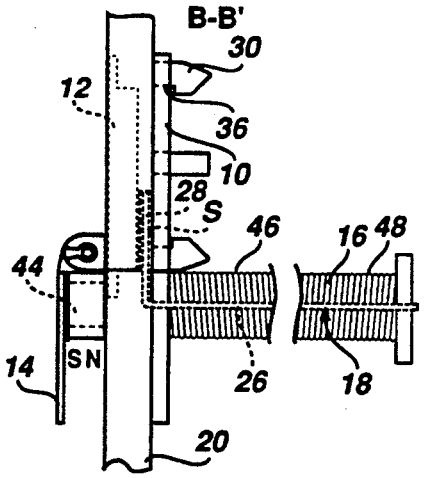
FIG. 6 is a sectional view of the pixel element taken along line B—B' of FIG. 5.
Figure 7:
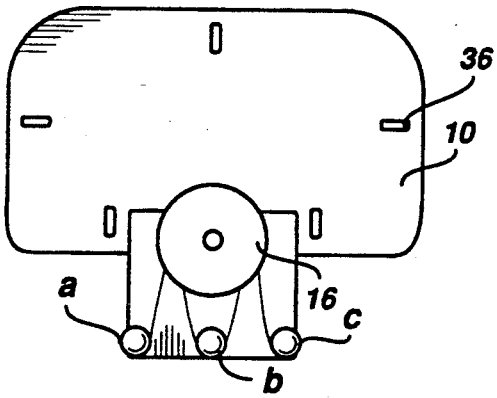
FIG. 7 is a rear view of the pixel element according to the present invention.

Referring to FIGS. 4, 6 and 7, the electromagnet 16 has a pair of coils 46, 48, respectively, wound in opposite directions therearound. Thus, as will be described in detail below, electricity is supplied to node "b" (FIG. 7), flows through one of the two coils and returns to either node "a" or node "c". In this manner, the pole piece is energized to act either as a south pole piece or a north pole piece, depending upon which coil is energized.

As noted above, the pixel elements are arranged in rows and columns to form an array of pixel elements. An important aspect of the invention is the manner in which a single pivot rod 42 can be used as the pivot rod for all of the pixel elements contained in each of the rows. Specifically, referring to FIG. 8, for each row of pixel elements, the pivot rod extends the entire width of the display device and is inserted through the hinges 38, 40 of each of the brackets 12 and flaps 14, respectively, of each of the pixel elements 7. Accordingly, once the brackets 12 and translucent members 10 of each of the pixel elements in a single row have been snapped together, as described above, the pivot rod 42 is inserted through the hinges of the brackets and flaps to thereby pivotally secure each of the flaps to each of the brackets. Such an arrangement allows for quick and easy assembly of the pixel elements 7 to the substrate 20 to thereby form the display device 6.

Figure 8:
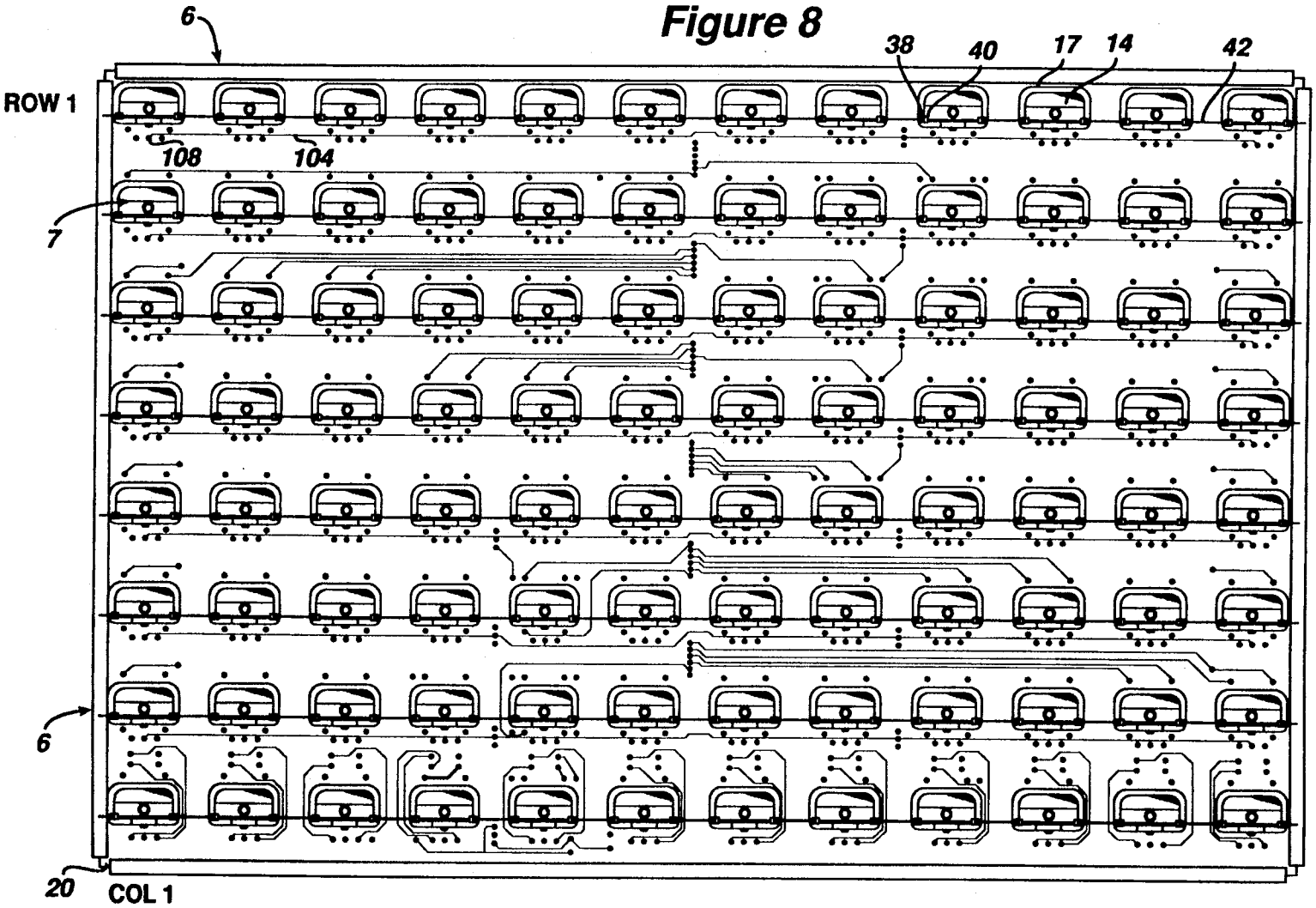
FIG. 8 is a front view of the electronic display device showing the electrical circuitry of the display device.
Figure 9:
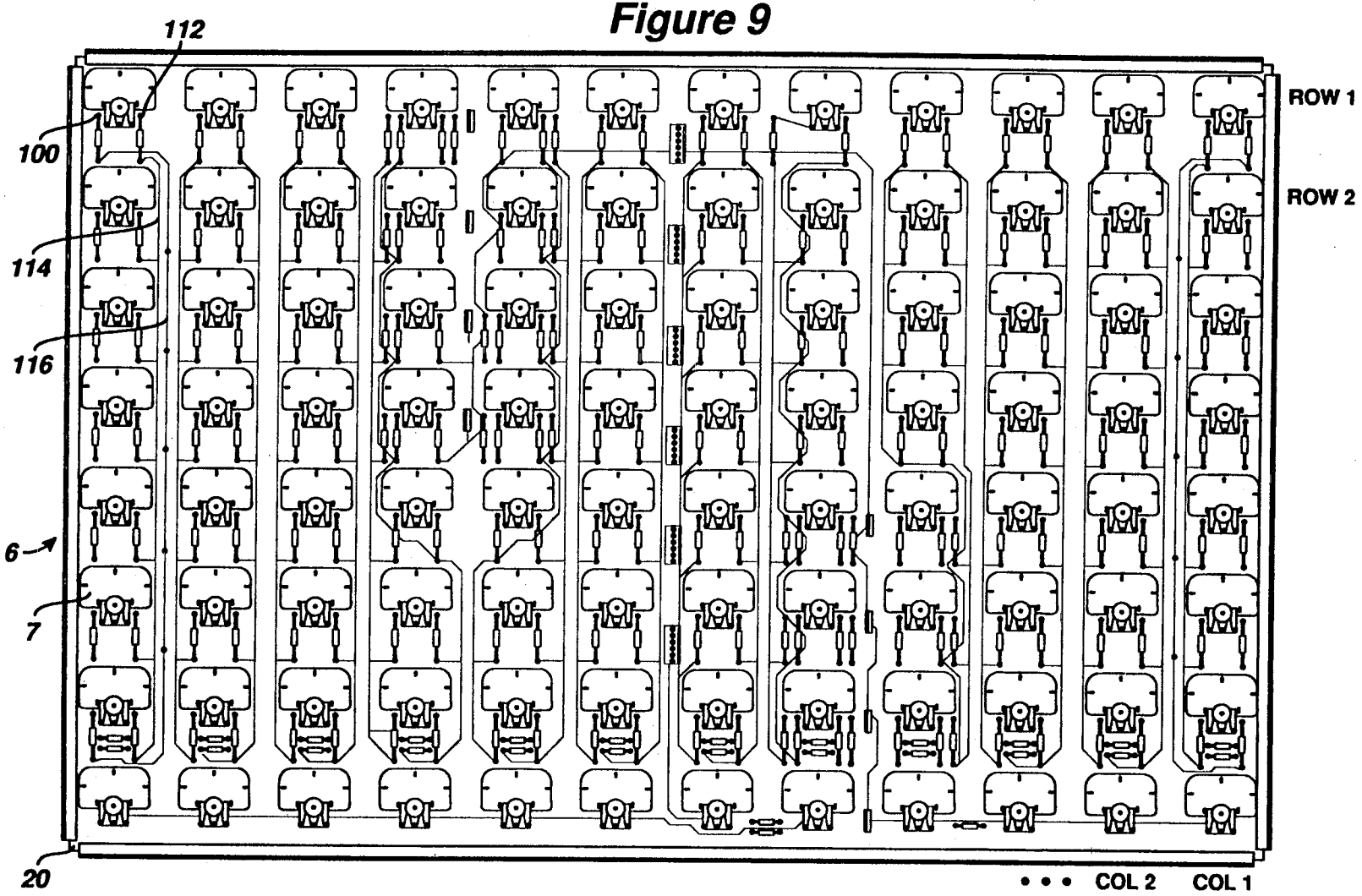
FIG. 9 is a rear view of the electronic display device showing the electrical circuitry.
Figure 10:
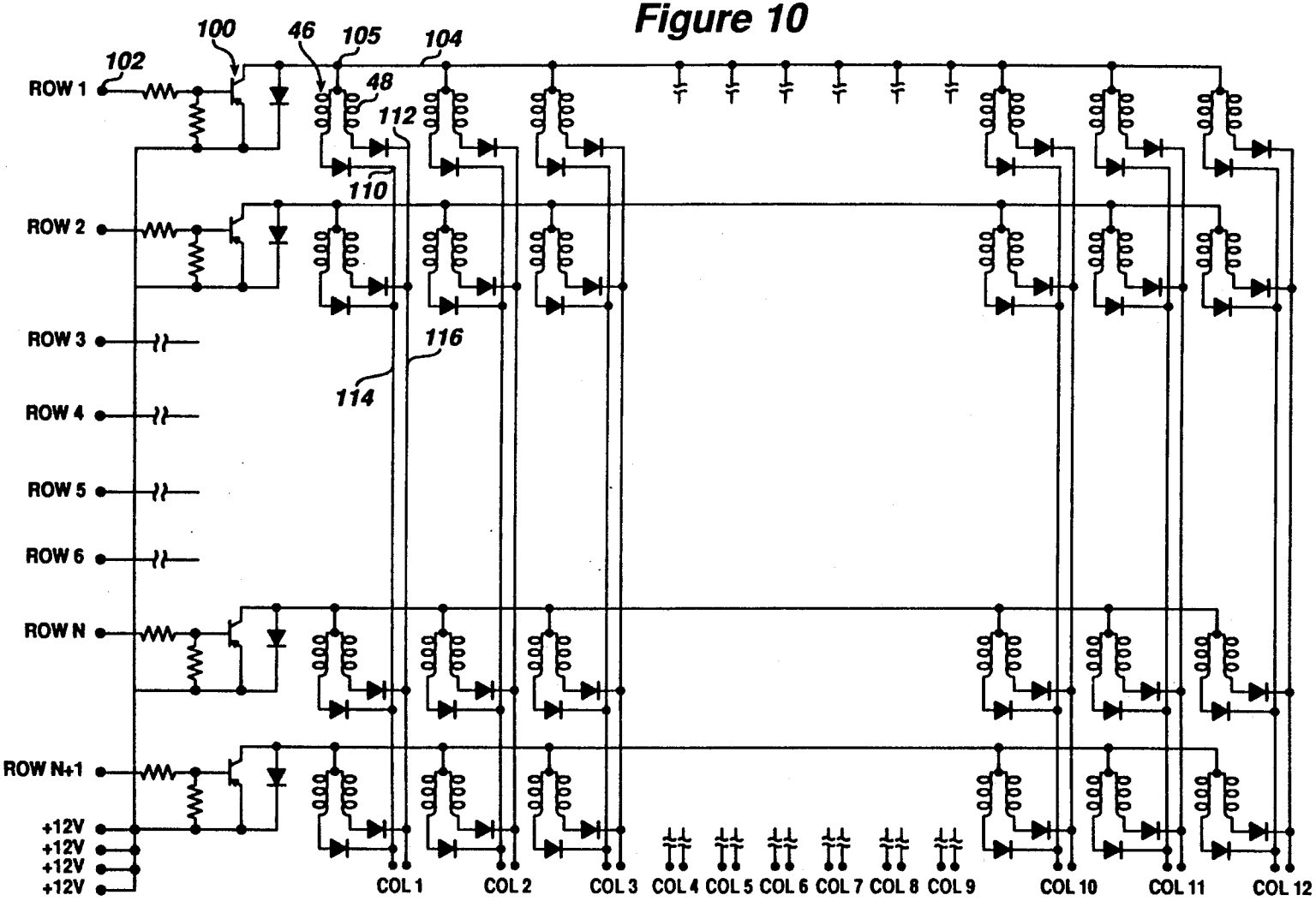
FIG. 10 is a schematic showing the electrical circuitry of a representative portion of the display device.

FIGS. 8–10 illustrate the electrical circuitry of the display device, FIG. 8 illustrating the front of the display device and FIG. 9 illustrating the back of the device. The substrate 20 is a printed circuit board designed in the conventional manner. By way of example, the following is a description of the wiring of a single pixel element constituted by row 1, column 1. Referring to FIG. 10, current is supplied by a power source to a switch 100 which is actuated by receiving a signal from a signal input line 102. When the switch 100 is in the "on" position, current flows through the switch and into line 104 communicating with of the electromagnets of each of the columns. As can be seen from FIG. 10, coils 46 and 48 are provided between point 105 and points 110, 112, respectively. Point 110 is provide on wire 114 while point 112 is provided on wire 116. Depending on whether line 114 or 116 is grounded, the current will either flow through coil 46 or 48, respectively, resulting in the pole piece being magnetized as either a north pole piece or a south pole piece.

The following is a description of the operation of the electronic display device. For the purpose of explanation, description will initially be limited to a single pixel element, row 1, column 1. As illustrated in FIG. 4, the magnet is secured to the flap 14 with either the south pole or the north pole disposed adjacent the flap. For purpose of description, we will assume that the south pole of the magnet is adjacent the flap, as illustrated in FIG. 4. Referring now to FIGS. 8–10, a signal is sent via line 108 to the switch 100 to close the switch. Additionally, either line 114 or line 116 is grounded. For this example, it is assumed that line 114 is grounded resulting in the current flowing through line 104 and through coil 46. In this condition, the current is supplied to the appropriate coil 46 of the electromagne 16 so that the pole piece 18 is energized to be a north pole piece, for example, thereby attracting the magnet 44 and retaining the flap in the closed position. In the closed position, the non-reflective surface 13 of the flap 14 faces the viewer such that the pixel element does not emit or reflect any light. To open the flap and thereby emit and reflect light, the other coil 48 is energized by grounding the other line 116 (FIG. 10) so as to convert the pole piece from a north pole piece to a south pole piece. In this case, as illustrated in FIG. 6, the flap 14 is pivoted 180° from the closed positions such that the north pole of the magent is adjacent the pole piece, thereby maintaining the flap in the open position. In this position, a light which radiated from behind the pixel element is emitted through the translucent member such that the translucent member 10 emits light in the direction of the viewer. Additionally, the reflective surface 15 of the flap 14 faces in the direction of the viewer to thereby reflect light in the direction of the viewer.

The display device is assembled in the following manner. Each of the electromagnets 16, translucent members 10 and brackets 12 of the pixel elements 8 are secured to the substrate 20 as follows. First, the electromagnet 16, having the pole piece 18 extending therefrom, is soldered to the back of the substrate 20. Next, the translucent member 10 is positioned on the back 22 of the substrate 20 and the radial leg 28 of the pole piece is inserted therein. Thereafter, the bracket 12, disposed on the front side 23 of the substrate 20, is secured to the translucent member 10 by inserting the legs 30 into the holes 36 of the translucent member. In this manner, the translucent member and the bracket are secured to the substrate 20. Thereafter, each of the flaps is secured to each of the brackets on a row by row basis. In particular, each of the pivot rods 42 is inserted through the hinges 38, 40 of each of the brackets and flaps, respectively, of the pixel elements 8 in an entire row, as described briefly above. In this manner, the pixel element can be quickly and easily assembled, thereby minimizing manufacturing costs.

I claim:

1. An electronic display device, comprising a substrate having a plurality of holes provided therein arranged in rows and columns;

a pixel element provided in each of said holes, said pixel element comprising:

a translucent member abutting against a back side of said substrate and covering one of said holes;

a mounting bracket abutting against a front side of said substrate, said bracket having fastening means extending through said one hole of said substrate and connecting to said translucent member for securing said translucent member to said substrate;

a flap pivotally secured to said bracket about a pivot axis, one side of said flap having a non-reflective surface and the other side of said flap having a reflective surface, said flap being pivotable from a first position where said non-reflective surface faces outwardly therefrom to a second position, approximately 180° from said first position, where said reflective surface faces outwardly therefrom;

a magnet disposed on said flap;

an electromagnet secured to the back side of said substrate, said electromagnet having a pole piece disposed axially therein and extending into said translucent member; and means for supplying an electric current to said electromagnet so as to alternatively energize said pole piece to be a south pole piece or a north pole piece;

wherein when said pole piece is energized to be one of a north pole piece and a south pole piece said flap is pivoted to said first position and when said pole piece is energized to be the other of said north pole piece and south pole piece said flap is pivoted to said second position.

2. The device of claim 1 wherein said electromagnet includes a pair of coils wound in opposite directions from one another, and wherein electric current is supplied to one of said coils to energize said pole piece to be a south pole piece and electric current is supplied to the other of said coils to energize said pole piece to be a north pole piece.

3. The device of claim 1 wherein said pole piece is L-shaped.

4. The device of claim 3 wherein a leg of said L-shaped pole piece extends into said translucent member in a direction parallel with respect thereto and wherein said magnet is positioned on said flap in such a manner that said magnet is adjacent said pole piece in both said first position and said second position.

5. The device of claim 4 wherein said magnet is disposed on said flap adjacent said pivot axis.

6. The device of claim 4 wherein said magnet is disposed on said flap such that the center thereof is a predetermined distance from said pivot axis and wherein the length of said leg of said pole piece is at least twice as long as said predetermined distance.

7. The device of claim 1 wherein fastening means comprises a plurality of legs extending therefrom which are inserted into holes provided in said translucent member.

8. An electronic display device, comprising:

a substrate having a plurality of holes provided therein arranged in rows and columns; and a pixel element provided in each of said holes, each said pixel element including:

a translucent member abutting against a back side of said substrate and covering one of said holes;

a mounting bracket positioned at a front side of said substrate and having fastening members extending through said one hole of said substrate and holding said translucent member in position at said back side of said substrate;

a flap pivotally secured to said mounting bracket by a pivot shaft which serves a plurality of flaps of a row of said pixel elements, said pivot shaft being releasably retained by said mounting bracket in said row of pixel elements, one side of said flap having a non-reflective surface and the other side of said flap having a reflective surface, said flap being pivotable from a first position where said non-reflective surface faces outwardly therefrom to a second position where said reflective surface faces outwardly therefrom; and energizing means for causing said flap to pivot about said pivot shaft from said first position to said second position, and vice versa, whereby each of said flaps in each row of said pixel elements is pivotally disposed on a single pivot shaft allowing all of said flaps in a row to be quickly and easily assembled by simply securing said pivot shaft for said row to said mounting brackets in said row.

9. The electronic display device of claim 8, wherein said energizing means comprises:

a magnet disposed on said flap;

an electromagnet secured to the back side of said substrate, said electromagnet having a pole piece disposed axially therein and extending into said translucent member; and current means for supplying an electric current to said electromagnet so as to alternatively energize said pole piece to be a south pole piece or a north pole piece, wherein when said pole piece is energized to be one of a north pole piece and a south pole piece said flap is pivoted to said first position and when said pole piece is energized to be the other of said north pole piece and said south pole piece said flap is pivoted to said second position.

10. The electronic display device of claim 9 wherein said electromagnetic magnet includes a pair of coils wound in opposite directions from one another, and wherein electric current is supplied to one of said coils to energize said pole piece to be a south pole piece, an electric current is supplied to the other of said coils to energize said pole piece to be a north pole piece.

11. The device of claim 9 wherein said pole piece is L-shaped.

12. The device of claim 11 wherein a leg of said L-shaped pole piece extends into said translucent member in a direction parallel with respect thereto and wherein said magnet is positioned on said flap in such a manner that said magnet is adjacent said pole piece in both said first position and said second position.

13. The device of claim 12 wherein said magnet is disposed on said flap adjacent said pivot shaft.

* * * * *